US008727958B2

(12) United States Patent
Schimmelpfennig et al.

(10) Patent No.: US 8,727,958 B2
(45) Date of Patent: May 20, 2014

(54) APPARATUS AND METHOD FOR TRANSFERRING ENERGY AND/OR A SUBSTANCE TO ROTATING MEANS

(75) Inventors: Winfried Schimmelpfennig, Krakow am See (DE); Holger Lantow, Rostock (DE); Juergen Schulz, Jesteburg (DE); Elmar Niklas Neuschaefer, Rostock (DE)

(73) Assignee: Miltenyi Biotech GmbH, Bergisch Gladbach (DE)

( * ) Notice: Subject to any disclaimer, the term of this patent is extended or adjusted under 35 U.S.C. 154(b) by 1043 days.

(21) Appl. No.: 12/742,571

(22) PCT Filed: Nov. 13, 2008

(86) PCT No.: PCT/EP2008/009597

§ 371 (c)(1),
(2), (4) Date: May 12, 2010

(87) PCT Pub. No.: WO2009/062714

PCT Pub. Date: May 22, 2009

(65) Prior Publication Data

US 2010/0261596 A1 Oct. 14, 2010

Related U.S. Application Data

(60) Provisional application No. 60/987,799, filed on Nov. 14, 2007.

(30) Foreign Application Priority Data

Nov. 14, 2007 (DE) ..... 10 2007 054 339

(51) Int. Cl.
*B04B 7/00* (2006.01)

(52) U.S. Cl.
USPC ..... 494/18; 494/84

(58) Field of Classification Search
USPC ..... 494/17, 18, 21, 45, 83, 84; 210/380.1, 210/380.3, 781, 782; 138/111
See application file for complete search history.

(56) References Cited

U.S. PATENT DOCUMENTS

| | | | | |
|---|---|---|---|---|
| 3,358,072 | A | 12/1967 | Wrench | |
| 3,885,735 | A * | 5/1975 | Westbert | 494/27 |
| 4,018,304 | A * | 4/1977 | Lolachi et al. | 184/6 |

(Continued)

FOREIGN PATENT DOCUMENTS

| | | |
|---|---|---|
| DE | 2 354 368 | 5/1974 |
| EP | 0 019 038 A1 | 11/1980 |

OTHER PUBLICATIONS

International Search Report for PCT/EP2008/009597, mailed on Mar. 16, 2009, three pages.

*Primary Examiner* — Charles E Cooley
(74) *Attorney, Agent, or Firm* — Nath, Goldberg & Meyer; Jerald L. Meyer; Stanley Protigal

(57) ABSTRACT

The presently disclosed subject matter proposes an apparatus (42) and a method for transferring energy and/or a substance from a non-rotating component of an apparatus to a rotating device (43)—or vice versa—through an intermediary component (1, 1'). In one configuration, the intermediary component (1,1') is a symmetrically arranged pair of tubes, useful in centrifugal separation, and which is subject to continuous rotation while tube ends are fixed in a lower, stationary range or stand still.

14 Claims, 3 Drawing Sheets

(56) References Cited

U.S. PATENT DOCUMENTS

| | | | | | |
|---|---|---|---|---|---|
| 4,109,852 | A | | 8/1978 | Brown et al. | |
| 4,114,802 | A | * | 9/1978 | Brown | 494/18 |
| 4,163,519 | A | * | 8/1979 | Stabile | 494/18 |
| 4,164,318 | A | * | 8/1979 | Boggs | 494/18 |
| 4,194,684 | A | * | 3/1980 | Boggs | 494/18 |
| 4,221,322 | A | * | 9/1980 | Drago et al. | 494/60 |
| 4,296,882 | A | * | 10/1981 | Kobayashi | 494/18 |
| 4,372,484 | A | * | 2/1983 | Larsson et al. | 494/14 |
| 4,425,112 | A | * | 1/1984 | Ito | 494/18 |
| 4,439,178 | A | * | 3/1984 | Mulzet | 494/85 |
| 4,459,169 | A | * | 7/1984 | Bacehowski et al. | 156/221 |
| 4,778,444 | A | * | 10/1988 | Westberg et al. | 494/56 |
| 4,874,358 | A | * | 10/1989 | Brimhall et al. | 494/37 |
| 4,950,401 | A | * | 8/1990 | Unger et al. | 210/360.1 |
| 5,431,814 | A | * | 7/1995 | Jorgensen | 210/399 |
| 5,501,840 | A | * | 3/1996 | Mantovani et al. | 494/18 |
| 5,665,048 | A | * | 9/1997 | Jorgensen | 494/18 |
| 5,996,634 | A | * | 12/1999 | Dennehey et al. | 138/109 |
| 7,008,366 | B1 | * | 3/2006 | Aitkenhead et al. | 494/18 |
| 7,452,323 | B2 | * | 11/2008 | Aitkenhead et al. | 494/45 |
| 8,257,239 | B2 | * | 9/2012 | Manzella et al. | 494/18 |
| 8,460,165 | B2 | * | 6/2013 | Manzella et al. | 494/18 |
| 2006/0111229 | A1 | * | 5/2006 | Aitkenhead et al. | 494/83 |
| 2009/0239730 | A1 | * | 9/2009 | Aitkenhead et al. | 494/18 |
| 2010/0261596 | A1 | * | 10/2010 | Schimmelpfennig et al. | 494/37 |

* cited by examiner

APPARATUS AND METHOD FOR TRANSFERRING ENERGY AND/OR A SUBSTANCE TO ROTATING MEANS

This is a National Phase Application filed under 35 U.S.C. 371 as a national stage of PCT/EP2008/009597, filed Nov. 13, 2008, an application claiming the benefit under 35 USC 119(e) U.S. Provisional Application No. 60/987,799, filed Nov. 14, 2007 and claims priority to German Patent Application No. 10 2007 054 339.7, filed Nov. 14, 2007, the content of each of which is hereby incorporated by reference in its entirety.

BACKGROUND

The present disclosure relates to an apparatus including at least one device which, in an operating condition of the apparatus, rotates about an axis of rotation at a first velocity, and at least one non-rotating device, and at least one means for feeding and/or drawing energy and/or a substance

BRIEF DESCRIPTION OF THE DRAWINGS

An exemplary embodiment of the present disclosure as well as portions thereof are explained in the appended drawings, wherein like reference numerals designate identical elements or structures, and wherein.

DETAILED DESCRIPTION

Figure 1:
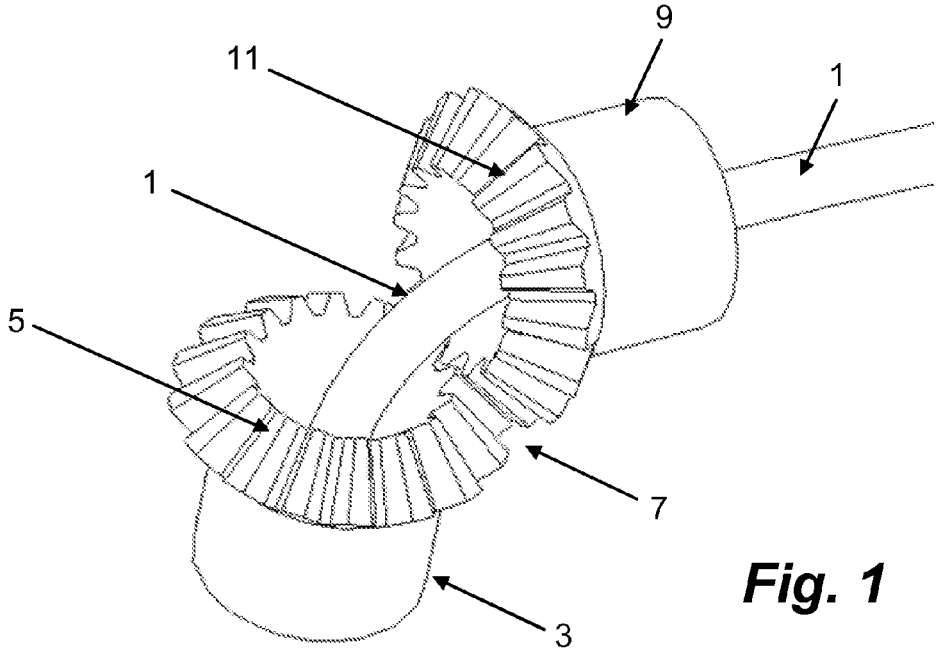
FIG. 1 shows the guidance of a tube for feeding and/or drawing a substance in a bevel gear pair having two bevel gears.

The present disclosure relates to an apparatus including at least one device which, in an operating condition of the apparatus, rotates about an axis of rotation at a first velocity, and at least one non-rotating device, and at least one means for feeding and/or drawing energy and/or a substance, in particular a suspension or a mixture of substances, from the non-rotating device to the rotating device, wherein in the operating condition at least one portion of the said means rotates at a second velocity that is different from the first velocity. The disclosure further relates to a method for transferring energy and/or a substance, in particular a suspension or a mixture of substances, from a device of this apparatus which does not rotate in an operating condition of an apparatus, to a device of the apparatus rotating about an axis of rotation at a first velocity, through the intermediary of a means including at least one portion which, in the operating condition, rotates at a second velocity that is different from the first velocity. The disclosure moreover relates to a use of an apparatus, preferably a laboratory or medical apparatus, and/or a use in biological processes, in particular purification processes.

In practice, apparatuses are known wherein energy is to be transferred and/or a substance is to be passed from a first, stationary or non-rotating device of an apparatus to a second, rotating device of this apparatus. An inherent technical problem resides in the guidance of corresponding conduits or lines or tubes between the non-rotating device and the rotating device.

In order to avoid, e.g., twisting of and damage to electrical lines for the transfer, e.g., of electrical energy between the two named devices, sliding contacts, coaxial rotary coupling devices and the like have been proposed in the prior art. These and other solutions do, however, involve friction and are moreover prone to malfunction. Furthermore, as a general rule abraded particles are produced, and leakages are observed in the transfer of substances through tubes. These are undesirable particularly in medical-technical applications where cleanness and hermetic closure are of prime importance.

An alternative for the rotary coupling device, for instance, is offered by the so-called lasso principle as described in U.S. Pat. No. 3,586,413 in connection with a centrifuge which includes a centrifuge chamber as a rotating device. It is indicated there that a tube is routed centrally into the centrifuge chamber in a horizontal direction into a shell, moved to one side of the chamber, out of the chamber through a side wall, and following a corresponding curvature is routed in the axis of rotation in a bottom-to-top orientation to a structure also disposed in a rotating manner above the centrifuge chamber. When the centrifuge is caused to rotate, the tube's arcuate section must also be guided around this chamber at one-half of the rotational speed. This revolution neutralizes the central twist of the tube: while the one end performs a continuous rotation jointly with the chamber, the tube end that is fixed in a lower, stationary range stands still. This affords possibilities for feed and discharge conduits or lines from a stationary part of the apparatus into a rotating part thereof. All of the connections are hermetically tight and do not require rotary coupling devices.

The three-dimensional non-symmetry of this connection principle does, however, necessitate technical compromises. The total mass of the rotating part must be high compared with the tube's arcuate section revolving at a different rotational speed, in order to keep unbalances and vibrations within limits. The rotational speed of the chamber is limited by the mass. In order to attain desired centrifugal forces, the centrifuge chamber moreover must have a correspondingly large diameter. These prior-art centrifuges are therefore comparatively large and heavy.

It is an object of the present disclosure to propose an improved apparatus for transferring energy and/or a substance from a stationary device of an apparatus to a rotating device of the apparatus, and vice versa.

The object of the disclosure is achieved through an apparatus including at least one device which, in an operating condition of the apparatus, rotates about an axis of rotation at a first velocity, and including at least one non-rotating device. The apparatus further comprises at least one means for feeding and/or drawing energy and/or a substance from the rotating device to the non-rotating device or vice versa, i.e., from the non-rotating device to the rotating device.

In terms of the disclosure, energy is understood to be any type of transferable energy. This includes in particular electrical energy, kinetic energy, for example due to moved masses, etc. The transfer of light and any type of waves is also covered by "energy" in this meaning, and so is the transmission of pressure and/or control signals.

The fed and/or drawn substance is to be understood as any substance, irrespective of its purity and of the phase in which it is present (liquid, gaseous, solidified). Such substance may also be a mixture of substances, in particular a suspension, a body fluid such as blood (or liquid and non-liquid contents thereof, in particular plasma, serum, thrombocytes, B or T cells, Leukocytes, erythrocytes, etc.), bone marrow, urine, liquor, tissue, cells, cell fragments and their constituents, etc. In accordance with the disclosure, "substance" is also understood, e.g., to designate semi-solid liquids, suspensions or mixtures such as cell cultures, cell-culture media, fermentation broths and media, micro-organisms such as fungi, bacteria, viruses or their constituents, or fragments such as, e.g., membranes, proteins, DNA, RNA, etc., as well as the media wherein they are stored, fermented, sorted, reproduced, centrifuged, separated or analyzed or treated, etc.

The means for feeding and/or drawing energy and/or a substance may include one or several portions whereby a transfer of energy or of the substance between rotating and non-rotating device may take place successively, alternatingly, or concurrently in one or opposite directions. In the framework of the present disclosure, "opposite directions" should be understood as a configuration wherein both a transfer from the non-rotating device to the rotating device and a transfer from the rotating device to the non-rotating device is taking place.

In the apparatus, the rotating device rotates about an axis of rotation at a first velocity while in the operating condition of the apparatus at least one portion of the means rotates about the axis of rotation at a second velocity. The first velocity is different from the second velocity. The thus operates according to the method also known as the lasso principle.

In accordance with the disclosure, the means of the apparatus is arranged symmetrically with the axis of rotation of the rotating device. The symmetric arrangement of the means for feeding and/or drawing on the apparatus advantageously counter-acts the occurrence of unbalances during rotation. As the unbalances of the means may be compensated as a result of the symmetric arrangement of the means in accordance with the disclosure, higher rotational speeds may be achieved at otherwise comparable overall conditions. This also means that when centrifugal forces occur in a same degree as in prior-art rotating devices, the weight ratio between the rotating device and the means may be altered advantageously in favor of lower masses and smaller dimensions of the rotating device. The entire apparatus may thus be manufactured to be smaller-sized and more cost-efficient.

The apparatus may be operated in such a way that portions of the means that is symmetric with the axis of rotation are commensurately loaded or charged with the substance being fed and/or drawn, so that even an unbalance caused by different loading of the means with substance in different portions thereof may additionally be avoided.

In terms of the disclosure, "symmetry" is first of all understood as a three-dimensional, geometrical symmetry. In terms of the disclosure, the expression symmetry is, however, also understood as a balanced state of all the portions of the means among each other during the rotation. A geometrically non-symmetric arrangement of the means having such a balanced structure of respective individual portions with regard to the weight and distance relative to the axis of rotation so as to reduce or altogether avoid the occurrence of unbalances, i.e., a symmetry or balance of the rotating masses of the means relative to each other, is thus also contemplated.

In the foregoing it was assumed that both the rotating device and the non-rotating device each are a constituent of one and the same apparatus. If, however, a first device of the two devices were in association with a first apparatus and a second device with a second apparatus while nevertheless communicating with each other through the means, then the first and the second apparatus are nevertheless understood as being merely one apparatus.

Advantageous developments of the apparatus are subject matter of the respective appended claims.

Thus, it is proposed in a preferred embodiment that the energy and/or the substance may be fed to the interior and/or drawn from the interior of the rotating device through the intermediary of the said means.

In this configuration, the apparatus may advantageously be employed, e.g., as a centrifuge and may thus advantageously replace prior-art solutions for centrifuges in which unbalances caused by the said means occur.

To this end, and as is presently provided in a further preferred embodiment, the means may comprise at least two feed and/or discharge conduits having a symmetrical arrangement relative to the axis of rotation, with this arrangement not being restricted to the particular configuration of the apparatus as a centrifuge. Rather, by means of the configuration of this embodiment a supply of oil to rotating machine parts for their lubrication may also take place. Similarly, by means of the above-described configuration, e.g., a supply of current to sensors present in the rotating device may take place.

The separately provided feed and/or discharge conduits which may, e.g., have the form of tubes with internally disposed cavities each extending in the longitudinal direction of the individual tube, or of electrical lines as well as combinations thereof, are present in a symmetric configuration, with "symmetric" designating any suitable type of symmetry. This in particular includes centrical symmetry but also mirror symmetry, rotational symmetry, and in particular the "weight" symmetry explained at the outset, as well as any other forms that the skilled person will identify as being appropriate and viable. These are equally encompassed by the present disclosure. Accordingly, an arrangement having more than two feed and/or discharge conduits—or even solutions having an odd number of feed and/or discharge conduits (e.g., three)—is covered by the present disclosure in accordance with the explanations given at the outset.

The provision of symmetrically arranged feed and/or discharge conduits may advantageously also result in a reduction of the dimensions of the individual feed and/or discharge conduit—in comparison with the prior art and at otherwise unchanged overall conditions—, for the transport capacity of the feed and/or discharge conduits may be distributed to more than only one feed and/or discharge conduit acting non-symmetrically and thus giving rise to an unbalance. This, too, advantageously contributes to a reduced tendency of the occurrence of an unbalance. Moreover a higher throughput of substance may be achieved through a feed and/or discharge conduit having the form of a tube, which does not result in an unbalance as it takes place in a symmetric manner.

When splitting the means into two or several feed and/or discharge conduits having a symmetric arrangement among each other, the individual feed and/or discharge conduits preferably rotate at a same velocity, e.g., at the second velocity.

The feed and/or discharge conduits may be comprised of solid or flexible or pliable materials or material compositions, preferably of a transparent material such as resin, silicone, polymers and polyurethanes, but also of metal(s) as well as compositions of various materials such as steel, stainless steel, metal alloys, metal/resin parts, etc. The feed or discharge conduits may also include at least one highly elastic transparent tube, in particular a multi-lumen tube, comprising silicone rubber or PUR (polyurethane) which will preferably be approved for medical usage.

In a further preferred embodiment, portions of the means extend through at least two bevel gears of at least one bevel gear pair. The bevel gears afford a particularly safe and reproducible guidance of the means or of portions thereof, respectively. As a result it is possible to avoid unbalances apt to occur due to the rotation of the means which is otherwise guided in a more freely movable manner. The bevel gears may be configured to be conical in an inner, particularly central area, in order to avoid friction contact with the guided means. The bevel gears may, e.g., be manufactured by using resin having excellent sliding properties (e.g., of POM, polyoxymethylene) or a slidable match of metal and resin, in order to minimize wear on the tooth profile and ensure a high running performance as well as smoothness of running.

In a further preferred embodiment, the rotating device is supported by at least one differential mechanism and/or driven by the latter in a rotational movement. The differential mechanism may include at least one bevel gear pair. It may, however, also effect a force transmission or force coupling in some other mechanical manner. Moreover the differential mechanism may also transfer force in any other manner known to the skilled person, e.g., by means of magnetic force coupling.

In another further preferred embodiment, the means includes at least one multi-lumen tube or at least one bundle of tubes. The provision of different lumens or lumina inside a common tube sheath advantageously serves a common and thus more stable guidance of the individual tubes or of the lumina which otherwise are present separately and are thus influenced differently by centrifugal forces. This also results in an enhanced reproducibility of the guidance of the individual lumina and in the avoidance of otherwise occurring unbalances which may in particular occur at different loading of the lumina.

At least one of the advantages named last, namely, the enhanced, reproducible guidance of the tube or means in general during rotation, may also be achieved with another further preferred embodiment of the apparatus, wherein the means includes a so-called core. This core may be arranged centrally in the tube or generally in the feed and/or discharge conduit, however may also be arranged in a different manner in or on the means. It prevents or reduces an undesirable elongation of the means due to the forces manifesting during a rotation as it can have a higher strength than the remaining tube material.

In another further preferred embodiment, the rotating device has the form of a centrifuge chamber, and the apparatus proper has the form of a centrifuge. Centrifuges are rotating separation systems wherein particles having different densities may be separated by centrifugal acceleration. Particles having a higher density will assume a stronger radial orientation, in comparison with the media surrounding them, than lower-density particles. Accordingly, higher-density particles concentrate at the outer periphery of the separation chamber of a centrifuge and may specifically be drawn off, separately from particles having a different density.

In the centrifugation of full blood or blood components, use is made, for example, of the fact that different blood cell types have densities that are different from each other and higher than that of the surrounding blood plasma. Thus, annularly concentrically arranged layers of the various cell types gradually form at the outer periphery of the centrifuge chamber as a function of the dwelling time in the centrifuge chamber and of the acting centrifugal force, with the cell-free blood plasma forming the innermost layer.

Centrifuges may be operated intermittently or, in turn, continuously. If they operate intermittently, they are charged, rotate during a predetermined period of time, and are subsequently emptied by taking into account the obtained spatial separation of the particles. Continuously operating centrifuges include a rotating chamber. This chamber is continuously supplied with the medium to be separated. Following passage through the chamber and concurrent separation of the medium owing to the differential effect of the centrifugal force on the particles, the single constituents of the medium are in turn continuously drawn from the radially forming layers by discharge conduits in different planes.

For cell-biology and medical applications, the centrifuge chamber may preferably be produced of a resin suitable for cast-molding and approved for medical usage, or include such a resin (e.g., acrylic or acetyl nitrilbutadiene styrene, polycarbonate, polymethylmethacrylate, polystyrene, etc.). The disclosed technology furthermore encompasses more sturdy designs of metal or glass.

When the apparatus is configured as a centrifuge, all of the above-mentioned advantages may advantageously be obtained. In order to avoid repetitions, reference is expressly made to their discussion given in the foregoing.

The described function is furthermore attained through a method for manufacturing such an apparatus which rotates about an axis of rotation at a first velocity, through the intermediary of a means including at least one portion which, in the operating condition, rotates at a second velocity that is different from the first velocity. The means are arranged relative to the axis of rotation. These methods undiminishedly arrive at all of the advantages mentioned above, so that express reference is here also made to their discussion that is given in the foregoing so as to avoid repetitions.

The apparatus may moreover be a component of an apparatus or machine, preferably of a laboratory or medical apparatus or of such a machine. In one preferred embodiment, the apparatus is a component of a cell separation apparatus or magnetic cell separation apparatus such as, e.g., the CliniMACS (Miltenyi Biotec GmbH of Bergisch Gladbach, Germany) or of an apparatus for dialysis or for the treatment of metabolic and other disorders. These include, e.g., disorders or pathological deviations regarding the cholesterol metabolism or cardiac-circulatory disorders such as cardiac infarction, apoplexy, autoimmune disorders as well as other disorders of the immune system, cancer, infectious diseases such as, e.g., hepatitis, AIDS. The apparatus may, however, also be part of a purification process or of an apparatus or machine for purifying substances/liquids/materials or mixtures of same or different phase. Purification by means of the apparatus may, e.g., take place in accordance with non-continuous or batch fermentation or in accordance with continuous fermentation, or after the previously mentioned materials or fluids were already obtained in some other manner such as, e.g., extraction of bone marrow, taking of blood, tissue or cell extraction. The apparatus may also be utilized in the production of drugs or therapeutic cells or tissues.

EXAMPLES

FIG. 1 shows a means comprising a tube 1 as a feed and/or discharge conduit for feeding and/or drawing a substance. The tube 1 is guided through a first bevel gear 3 having a gear rim 5 of a first bevel gear pair or mechanism 7 as well as a second bevel gear 9 having a gear rim 11 of the first bevel gear pair 7.

In the embodiment exemplarily represented in FIG. 1, the axes of the two bevel gears 3 and 9 form an angle of 90 degrees. As a result, the tube 1 extends in an arc of equally 90 degrees from the first bevel gear 3 to the second bevel gear 9. As the tube 1 is fixedly immobilized in both bevel gears 3 and 9, it has to follow the rolling movements of the bevel gears 3 and 9 by bending elastically in accordance with the respective direction of rotation of the bevel gear pair 7.

A fixation of the tube 1 both in the bevel gear 3 and in the bevel gear 9 is optional, however. In other words, in order to attain the disclosed effect, it is sufficient to fixedly arrange the tube 1 in only one—or even none—of the two bevel gears. A fixed arrangement of the tube in one bevel gear or in two bevel gears, as is suggested in FIG. 1, may facilitate hermetic sealing between the tube 1 and the passage opening for the tube 1 in the bevel gears 3 and 9. It is therefore not necessary, particularly in cases not requiring hermetic sealing, to do away with the fixation.

Bevel gear 3, which is represented in FIG. 1 as a lower, vertically oriented bevel gear, stands still in the condition of use of the associated apparatus. Accordingly it does not rotate. At every revolution of the bevel gear mechanism, the portion of the tube 1 represented at the right-hand margin of FIG. 1 therefore performs precisely one rotation about its longitudinal axis jointly with the second bevel gear 9—a (satellite) bevel gear. This movement is taken, together with the tube 1, in an arc around a centrifuge chamber represented in FIG. 4 and discussed in connection with FIG. 4, and passed on to a second bevel gear mechanism or bevel gear pair represented in FIG. 2.

The respective bevel gears 3, 9 are configured in a central area thereof so as not to create an interference with the circling movement of the tube 1. Moreover, contact between tube 1 and bevel gear tooth profiles is effectively prevented. Friction and possibly destruction of the tube 1 or a reduction of the functionality of the bevel gear pair 7 or of the guidance of the tube 1 in the bevel gear pair 7 is thus advantageously avoided. This may be favored or achieved thanks to the fact that the tube 1 is fixed in the bevel gears 3 and 9, through which it is guided, on the respective one side facing away from the gear rim 5 or 11. The fixation on the (satellite) bevel gear 9 here receives the tensile force acting on the tube's outer arcuate section 1 as a result of the centrifugal force. The same is equally true for the fixations of the (satellite) bevel gears described further below with reference to additional figures. In this way it is possible to ensure such a guidance of the tube 1 that an occurrence of unbalances is counter-acted. Concurrently, damage to the tube 1 by the gear rim 5 or 11 itself may be avoided. This solution is possible with each tube or tube end described or mentioned in the following. It may be realized irrespective of other features.

The relative position of the axes of bevel gears 3 and 9 is arbitrarily determined to be 90 degrees in the present example. As will be evident to the skilled person, different axis positions are equally possible and are therefore encompassed by the disclosed technology.

Figure 2:
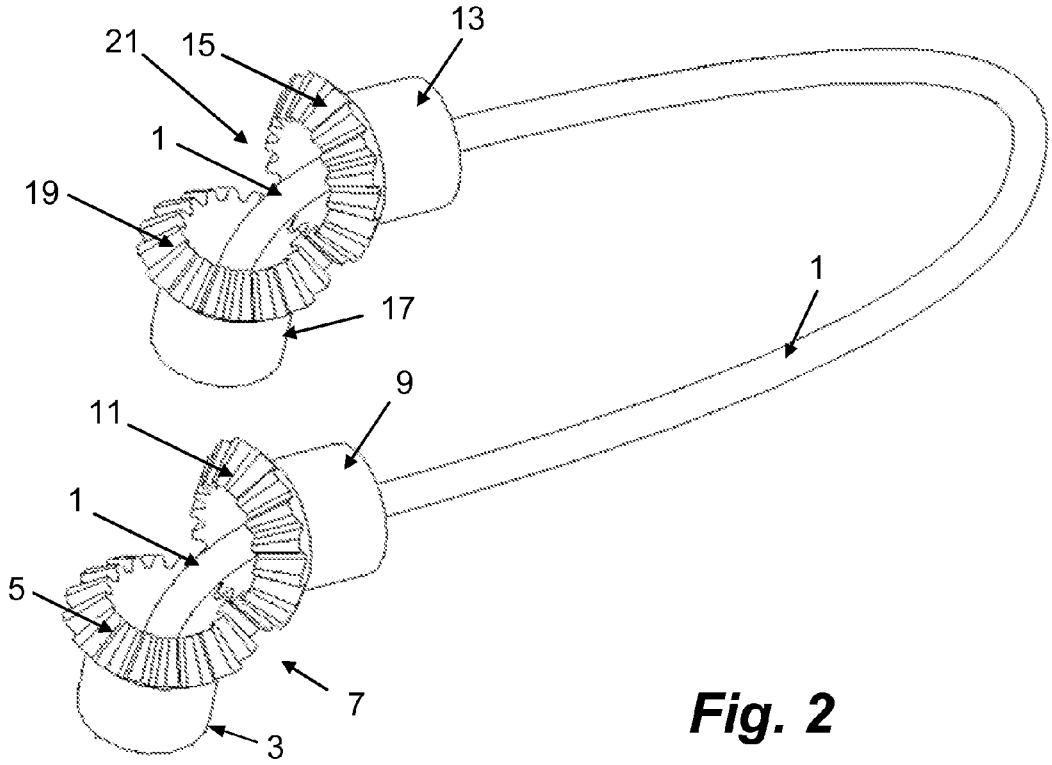
FIG. 2 shows the tube of FIG. 1 being guided both in a lower and in an upper bevel gear pair.

FIG. 2 shows the tube 1 as represented in FIG. 1. FIG. 2 in addition shows a second end of the tube 1 which is passed through a third bevel gear 13 having a gear rim 15 to a fourth bevel gear 17 having a gear rim 19. The third bevel gear 13 and the fourth bevel gear 17 form the second bevel gear mechanism or pair 21.

In the example shown in FIG. 2, the tube 1 is fixedly connected in all of the bevel gears 3, 9, 13, and 17. Through the intermediary of the tube 1, a revolution of the bevel gear 9 about the bevel gear 3 causes the bevel gear 13 to revolve about the bevel gear 17 and thus in the bevel gear 17 being driven, as will be explained more accurately in regard of FIG. 3.

Figure 3:
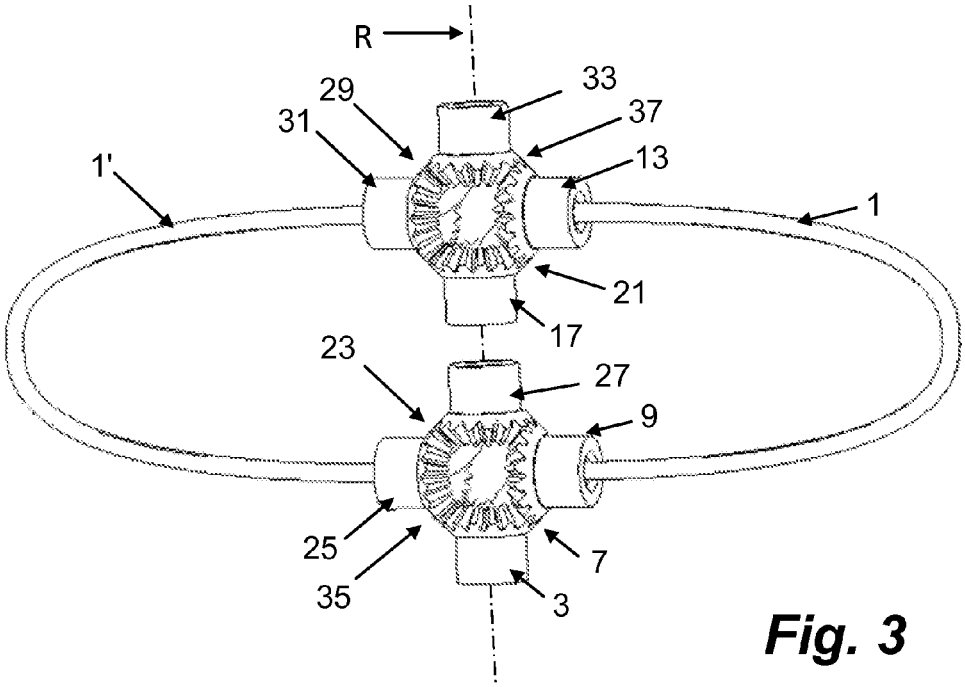
FIG. 3 shows the guidance of two tubes in two separately present differential mechanisms including bevel gear pairs.

If, in the arrangement shown in FIG. 2—as is visible in FIG. 3—a second tube 1' is arranged symmetrically to the tube 1, and if the bevel gear pairs 7 and 21 including the bevel gears 3 and 9 or 13 and 17, respectively, are supplemented by a third bevel gear mechanism or bevel gear pair 23 including bevel gears 25 and 27, and by a fourth bevel gear pair 29 including bevel gears 31 and 33, this results in two complete differential mechanisms 35 and 37. The differential mechanisms 35 and 37 each comprise a differential cage or a differential casing 39 or 41 surrounding them, respectively. To the skilled person it is discernible that in the structure shown in FIG. 3, the means for feeding and/or drawing a substance is symmetric with tubes 1 and F. As a result, unbalances which might occur owing to a separate rotation of the tubes 1 and 1' about a central axis of rotation R extending vertically in FIG. 3 (represented as a dot-dashed line) may cancel each other out. Due to the achieved reduction or even avoidance of unbalances, the speed of rotation may accordingly be set higher, and the dimensions and masses of the overall arrangement may be selected to be comparatively small.

Figure 4:
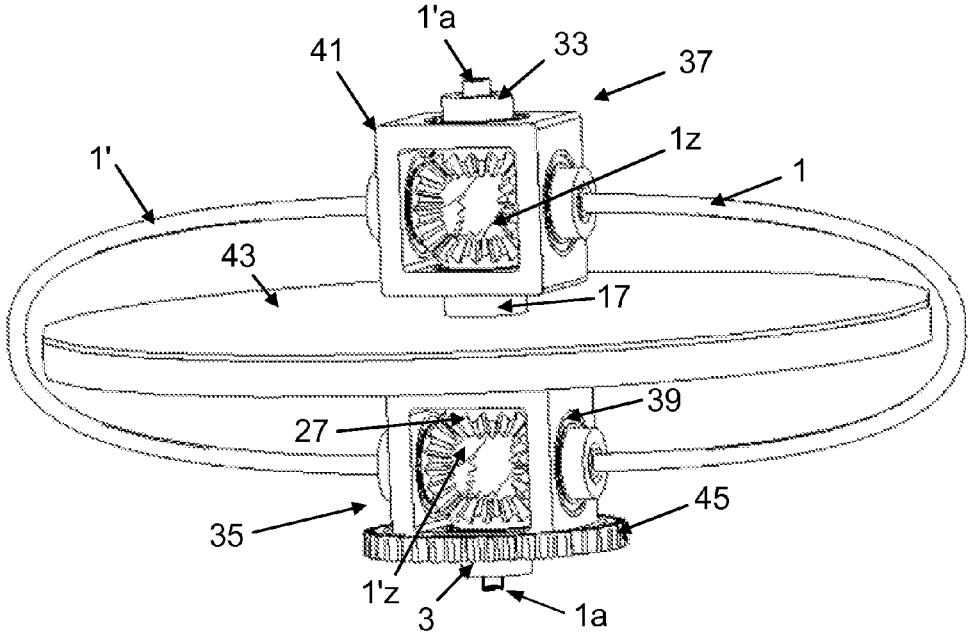
FIG. 4 shows a centrifuge having a centrifuge chamber which includes elements of the preceding FIGS. 1 to 3.

While FIGS. 1 to 3 show the principle of the arrangement of the means for feeding and/or drawing energy or a substance of the apparatus as well as details hereof, FIG. 4 represents is in a schematically simplified manner—in addition to what was already shown and further details—an apparatus 42 including a rotating device.

As may be seen in FIG. 4, the differential mechanisms 35 and 37 support a centrifuge chamber 43 and drive the latter at least through the intermediary of the differential cage 41. Driving of the centrifuge chamber 43 takes place indirectly at a ratio of 2:1 by way of the rotation of at least one of the differential casings 39 or 41, respectively. In order to bring about the rotation of the differential casing 39, a cylinder gear 45 fixedly connected to the latter is provided. In the operating condition of the apparatus 42, the bevel gears 3 and 33 stand still. The same is true for the tube portions 1*a* and 1'*a* exiting in a downward direction from the bevel gear 3 and in an upward direction from the bevel gear 33, respectively. They also stand still. The bevel gears 17 and 27 situated most closely to the centrifuge chamber 43, which are fixedly connected to the rotating centrifuge chamber 43, rotate jointly with the respective tube ends 1*z* and 1'*z* passing through them and visible in FIG. 4. The revolving (satellite) bevel gears 9, 13, 25, and 31 support and in the process guide the arcuate tube sections in the areas of their respective ends while symmetrically receiving symmetric centrifugal forces.

The bevel gears 17 and 27, which are fixedly connected to the centrifuge chamber 43, receive the respective tubes 1 and 1' from the (satellite) bevel gears 13 and 25. This arrangement results in a doubled rotational speed of the centrifuge chamber 43 relative to the differential cages 39 and 41 and relative to the associated tube ends, so that no twisting of the tubes 1 or 1' may occur.

Figure 5:
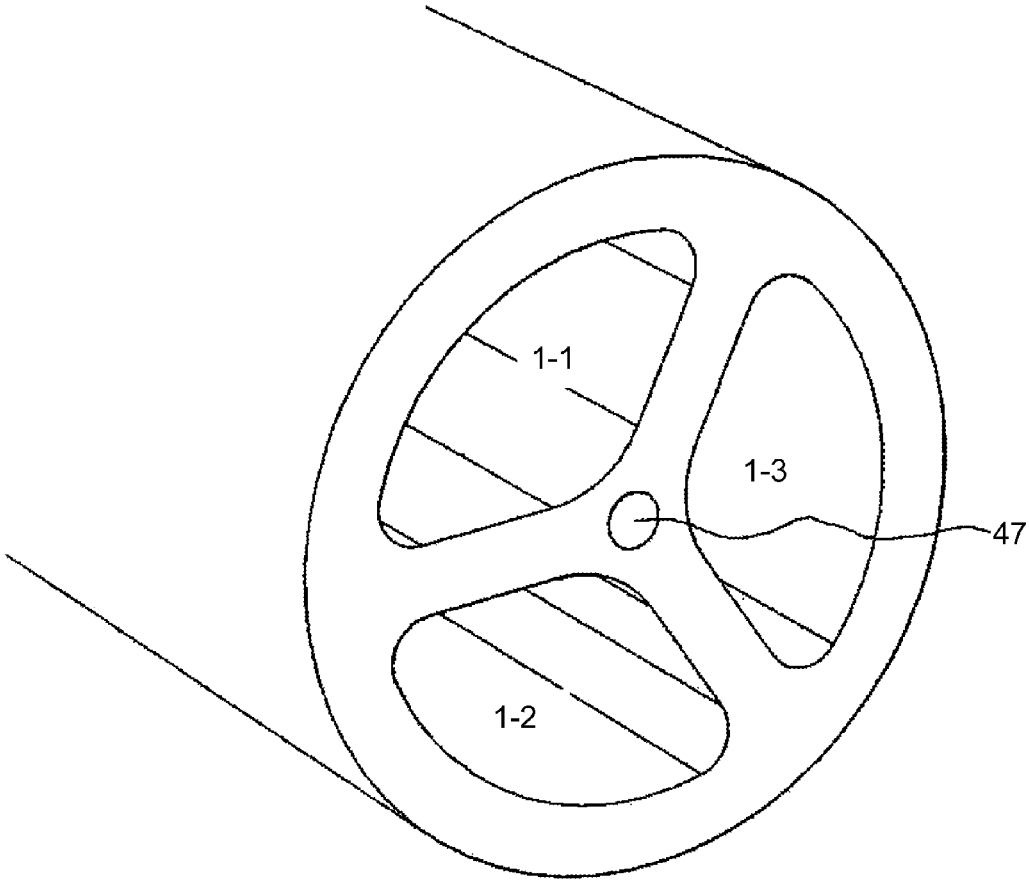
FIG. 5 is a cross-sectional view of a tube for use in the apparatus.

FIG. 5 shows a schematically simplified cross-sectional view of a tube 1 usable in the framework of the present disclosure and having three separate lumina, 1-1, 1-2, and 1-3. By using the tube shown in FIG. 5, or a tube having the cross-section shown in FIG. 5, it is possible to introduce or discharge up to three substances, mixtures of substances, suspensions, etc. into or from the rotating device of the apparatus. The common accommodation of the three lumina inside one tube—instead of the provision of separate tubes or bundle of tubes—serves for an advantageously improved reduction or avoidance of unbalances during operation of the apparatus inasmuch as the spatial closeness of the lumina is being maintained. This is relevant in particular when only single ones of the three lumina are charged with substance, with at least one of the remaining lumina, on the other hand, remaining empty at least temporarily. In such a case the centrifugal forces have a highly different influence on the individual lumina and are more readily apt to result in a deformation of the tube and an associated possible unbalance, than if they are combined into one tube having the cross-section shown in FIG. 5. The skilled person need not be reminded that the tube having the number of lumina shown in FIG. 5 may equally have a number of, e.g., two, four or more lumina.

As may furthermore be seen in FIG. 5, the tube 1—just like the tube 1'—may include a core 47, for instance on its inside. This core 47 may be made of a correspondingly sturdy or strong material and may, thanks to its enhanced strength in comparison with the remaining tube material, produce an improved overall strength of the tube 1 when centrifugal forces act on it due to the operation of the apparatus. The core 47 prevents a disadvantageous elongation of the tube 1 which is made, e.g., of elastic resin. This in turn contributes to a reduction or even avoidance of unbalances.

The core 47—which may have any desired position inside the tube 1 or also on the tube 1—may moreover be adapted to be electrically or optically conductive. In this way, the tube 1 is advantageously suited for the transfer of substances, signals, in particular control signals, pressure, as well as electrical energy. All this is equally true for any further tube such as tube 1'.

The disclosed technology thus for the first time proposes an apparatus for transferring energy and/or a substance from non-rotating means of an apparatus to rotating means—or vice versa—through the intermediary of a suitable means. It furthermore specifies a manufacturing method.

The invention claimed is:

1. An apparatus comprising:

at least one device which, in an operating condition of the apparatus, rotates about an axis of rotation at a first velocity, and at least one non-rotating device;

at least one means for feeding and/or drawing energy and/or a suspension or a mixture of substances, from the non-rotating device to the rotating device, the means comprising at least two tubes having a centrically symmetric arrangement relative to the axis of rotation; and at least one differential mechanism supporting the rotating device, wherein in the operating condition at least one portion of the said means rotates at a second velocity that is different from the first velocity, characterized in that the means is arranged symmetrically relative to the axis of rotation.

2. The apparatus according to claim 1, wherein the said energy and/or substance may be fed to the interior and/or drawn from the interior of the rotating device through the intermediary of the said means.

3. The apparatus according to claim 1, wherein:

said at least one differential mechanism comprises a bevel gear arrangement; and portions of the means extend through at least two bevel gears of at least one bevel gear pair in the bevel gear arrangement.

4. The apparatus according to claim 3, wherein said at least one differential mechanism with the bevel gear pair is driven by the apparatus in a rotational movement.

5. The apparatus according to claim 1, wherein the means includes at least one multi-lumen tube.

6. The apparatus according to claim 1, wherein the means includes a core.

7. The apparatus according to claim 1, wherein the rotating device has the form of a centrifuge chamber.

8. A method for transferring energy and/or a suspension or a mixture of substances, comprising:

providing an apparatus comprising a device of the apparatus which rotates about an axis of rotation at a first velocity;

transferring the energy and/or suspension or mixture of substances from a component of the apparatus which does not rotate in an operating condition of the said apparatus, to the device of the apparatus which rotates about an axis of rotation at a first velocity, through the intermediary of a means including at least one portion which, in the operating condition, rotates at a second velocity that is different from the first velocity, said means comprising at least two tubes having a centrically symmetric arrangement relative to the axis of rotation, characterized by the step of arranging the means symmetrically relative to the axis of rotation.

9. The method according to claim 8, characterized by the step of supplying and/or drawing the energy and/or substance into the interior or from the interior of the rotating device through the intermediary of the means.

10. The method according to claim 8, characterized by the step of providing portions of the means which extend through at least two bevel gears of at least one bevel gear pair.

11. The method according to claim 10, characterized by the step of providing at least one differential mechanism whereby the rotating device is supported and/or may be driven in a rotational movement, the differential mechanism including the bevel gear pair.

12. The method according to claim 8, characterized by the step of providing at least one of said tubes in the form of a multi-lumen tube.

13. The method according to claim 8, characterized by the step of providing at least one core inside the means.

14. The method according to claim 8, characterized by the step of configuring the rotating device as a centrifuge chamber.

* * * * *

UNITED STATES PATENT AND TRADEMARK OFFICE

CERTIFICATE OF CORRECTION

PATENT NO. : 8,727,958 B2
APPLICATION NO. : 12/742571
DATED : May 20, 2014
INVENTOR(S) : Schimmelpfennig et al.

It is certified that error appears in the above-identified patent and that said Letters Patent is hereby corrected as shown below:

On the Title Page, Item (73)

Please delete

"(73) Assignee: MILTENYI BIOTECH GMBH, Bergisch Gladbach (DE)),"

and replace with the following Assignee Name.

(73) Assignee: MILTENYI BIOTEC GmbH, Bergisch Gladbach (DE)

Signed and Sealed this
Twelfth Day of August, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,727,958 B2
APPLICATION NO. : 12/742571
DATED : May 20, 2014
INVENTOR(S) : Schimmelpfennig et al.

It is certified that error appears in the above-identified patent and that said Letters Patent is hereby corrected as shown below:

In the Specification:

In Column 8, Line 7, delete "1 and F." and insert -- 1 and 1'. --, therefor.

Signed and Sealed this
Twenty-eighth Day of October, 2014

Michelle K. Lee

Michelle K. Lee
*Deputy Director of the United States Patent and Trademark Office*